United States Patent [19]

Graef et al.

[11] 4,450,978

[45] May 29, 1984

[54] APPARATUS FOR RETRIEVING PAPER MONEY BILLS PRESENTED BUT NOT PICKED UP AT AUTOMATIC TELLER MACHINE BILL DELIVERY STATION

[75] Inventors: Harry T. Graef, Massillon; Scott A. Mercer, Hanoverton; Jeffrey A. Hill, Canton; Kevin H. Newton, North Canton; John C. Bozzelli, Tallmadge, all of Ohio

[73] Assignee: Diebold Incorporated, Canton, Ohio

[21] Appl. No.: 405,057

[22] Filed: Aug. 4, 1982

[51] Int. Cl.[3] ..... G07F 11/00

[52] U.S. Cl. ..... 221/13; 221/21; 221/195; 271/3.1; 271/4; 271/34; 271/163; 271/207; 271/DIG. 9; 194/DIG. 26

[58] Field of Search ..... 194/DIG. 26; 221/2, 221/9, 13, 21, 15, 191, 194, 195; 271/3, 4, 34, 163, 207, 3.1, DIG. 9; 209/534

[56] References Cited

U.S. PATENT DOCUMENTS

| | | | |
|---|---|---|---|
| 3,072,237 | 1/1963 | Simjian | 194/DIG. 26 |
| 3,410,384 | 11/1968 | Travioli | 194/DIG. 26 |
| 4,131,273 | 12/1978 | Kufrin et al. | 271/DIG. 9 |
| 4,191,369 | 3/1980 | Matsuda et al. | 271/DIG. 9 |
| 4,313,601 | 2/1982 | Graef et al. | 271/207 |
| 4,340,150 | 7/1982 | Guibord et al. | 194/DIG. 26 |

*Primary Examiner*—Joseph J. Rolla
*Assistant Examiner*—Lawrence J. Miller
*Attorney, Agent, or Firm*—Frease & Bishop

[57] ABSTRACT

A retrieval mechanism for a divert-container-equipped ATM of typical construction to retrieve and protect paper money bills dispensed at a customer's request by the ATM and left at an accessible location at the ATM bill delivery station unpicked by the customer. The unpicked bills are sensed after a short time delay in unpicked status. The unpicked bills when sensed are automatically returned to the reversible conveyor of such typical divert-container-equipped ATM and transported by reversal of the conveyor to the divert container.

24 Claims, 7 Drawing Figures

APPARATUS FOR RETRIEVING PAPER MONEY BILLS PRESENTED BUT NOT PICKED UP AT AUTOMATIC TELLER MACHINE BILL DELIVERY STATION

CROSS-REFERENCE TO RELATED PATENT

The apparatus of the invention comprises improvements on the device shown in U.S. Pat. No. 4,313,601, dated Feb. 2, 1982.

BACKGROUND OF THE INVENTION

1. Field of the Invention

The invention relates to automatic banking or teller machines (ATM's) and particularly to cash or paper money bill dispenser mechanism for ATM's frequently installed at remote locations. More particularly the invention relates to the construction and operation of a simple mechanism which may be incorporated in an ATM for retrieving one or more paper money bills presented at a customer bill delivery station of such ATM, but which bills have not been picked up by the customer, and which bills automatically are retrieved from the delivery station and delivered to a sealed, tamper-indicating divert container, such as shown in said U.S. Pat. No. 4,313,601, with which the ATM is equipped.

Also the invention relates to the coordinated relationship between the bill dispensing mechanism of such divert container-equipped ATM, and the improved bill retrieval mechanism which enables bills inadvertently or otherwise located but not picked up at the ATM bill delivery station to be retrieved by the dispensing mechanism and protectively stored in the divert container of such ATM.

2. Description of the Prior Art

Prior devices are known which recognize the problem of unpicked bills, and which retrieve bills delivered to but not picked up at a bill delivery station of an ATM. However, such prior devices have required the installation of a separate special transport device for withdrawn unpicked bills from the bill delivery station and conveying such bills to a protective container, and have also required a special retrieved bill container for such purpose.

Accordingly, there is a need existing in the art for a construction and arrangement of simple retrieval mechanism which may be incorporated in a typical ATM and coordinated with the normal operation of such ATM equipped with a divert container so that the transport or conveyor mechanism and divert container of such typical ATM may be used in their normally operating functional manner to enable unpicked bills when sensed at the ATM bill delivery station to be relocated at such station to a position to be engaged by the normal ATM transport mechanism and conveyed thereby to the divert container of such ATM.

SUMMARY OF THE INVENTION

Objectives of the invention include providing a simple mechanism for retrieving unpicked paper money bills from an ATM bill delivery station; providing such retrieval mechanism in which a bill presentation tray is mounted within the ATM at the bill delivery station adjacent the customer access opening in the ATM facia, movable between a normal position permitting a customer to remove dispensed bills from the tray through the access opening, and a retrieval position enabling unpicked bills in the tray to be conveyed to a protective container; providing such retrieval mechanism in which the tray location when moved to retrieval position pushes the unpicked bills on the tray to contact with a reversible transport conveyor of the divert container-equipped ATM so that upon reversal of conveyor movement the bills are withdrawn from the tray and are delivered to and deposited in the ATM divert container; providing such retrieval mechanism with a sensor which actuates tray movement to retrieval position upon sensing unpicked bills in the tray when the latter is in normal position; providing such retrieval mechanism in which the ATM transport conveyor movement is reversed upon actuation of tray movement to retrieval position; providing such retrieval mechanism and coordinated arrangement with the ATM in which it is incorporated to achieve the stated objectives in an efficient and secure manner; and providing such retrieval mechanism with a simple construction and operation which satisfies needs existing in the field of operation of ATM's.

Such objectives are obtained by the construction, arrangement and operation of equipment the general nature of which may be stated as retrieval mechanism for unpicked paper money bills dispensed by an ATM dispenser mechanism and discharged from the delivery end of said dispenser mechanism's reversible belt conveyor to a bill delivery station including, a bill receiving and presentation tray mounted for movement at said delivery station between a normal position receiving bills discharged by said conveyor for customer removal, and a retrieval position for withdrawal from the tray of unpicked bills thereon by said conveyor belt delivery end when the conveyor is reversed; drive means for moving the tray between normal and retrieval positions; sensor means operative, when sensing unpicked bills on the tray when in normal position, to energize the drive means to move the tray to retrieval position; and means for reversing belt conveyor movement upon energizing said drive means.

BRIEF DESCRIPTION OF THE DRAWINGS

A preferred embodiment of the invention - illustrative of the best mode in which applicants have contemplated applying the principles - is set forth in the following description and shown in the drawings and is particularly and distinctly pointed out and set forth in the appended claims.

Similar numerals refer to similar parts throughout the various figures of the drawings.

DESCRIPTION OF THE PREFERRED EMBODIMENT

Figure 1:
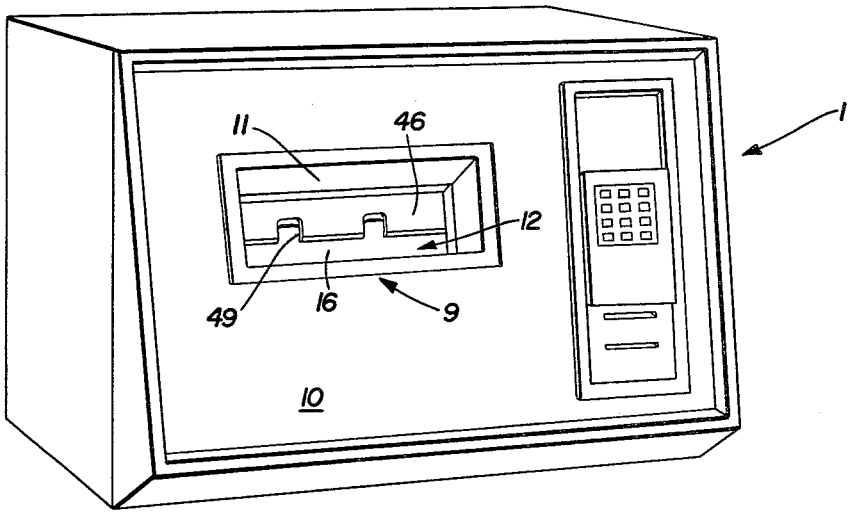
FIG. 1 is a somewhat diagrammatic perspective view of a typical or known ATM equipped with the improved retrieval mechanism of the invention.

A typical known type of ATM for dispensing currency in response to the presentation of a bank customer of coded card means is diagrammatically illustrated at 1 in FIG. 1. The ATM 1 is of a type shown in U.S. Pat. No. 4,313,601 and is equipped with dispensing mechanism having a reversible transport conveyor 2 and a divert container 3; and such ATM 1 may be operated in the usual manner as described in said U.S. Pat. No. 4,313,601.

Cash dispensing devices contained within the housing of ATM 1 may include supplies of two denominations of bills, in separate but side by side containers 4 and 4*a*, and dispensing or picker mechanisms in housing 5 which delivers paper money bills from the supplies 4 and 4*a* to the transport mechanism 2. Paper money bills delivered to the transport 2 are normally conveyed between the lower reach of an endless belt conveyor 6 in the direction of the arrow 7 along a conveyor platen 8 to the bill dispensing or delivery station generally indicated at 9.

In accordance with the invention, the facia 10 of the ATM 1 is formed with an access opening 11 communicating with a delivery compartment 12 formed by delivery station back and top housing walls 13 and 14 and facia 10 enclosing the bill dispensing delivery end 15 of the transport belt conveyor 6.

The lower end of housing back wall 13 is curved and directed forward and downward, as a housing bottom wall 16, to the lower portion of access opening 11. Housing side walls 17 and 18 complete the formation of the delivery compartment 12. The housing back wall 13, top wall 14, and bottom wall 16 extend between the side walls 17 and 18, and preferably are attached to said side walls by flange portions 19 and 20. The top wall 14 preferably has front and rear flanges 14*a* and 14*b* connected, respectively, to the facia 10 and to an interior wall 21 of the ATM 1.

A delivery compartment upper front wall portion 22 also preferably is mounted by flanges 23 on the side housing walls 17 and 18 and extends between said side walls. The lower end of front wall portion 22 preferably is formed with a reversely bent portion 24 connected with the member forming the access opening 11.

Figure 3:
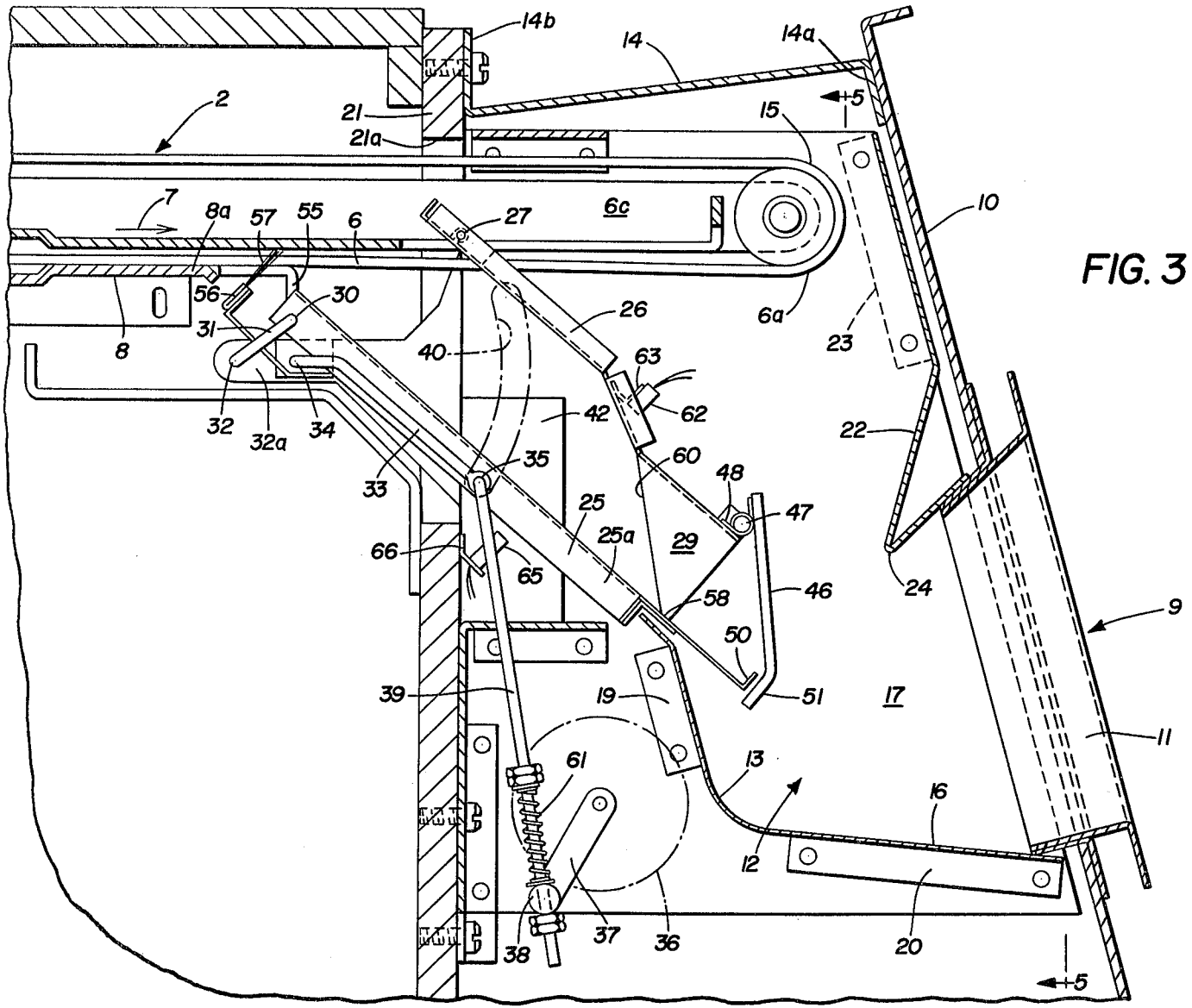
FIG. 3 is an enlarged fragmentary sectional view illustrating various components of the improved retrieval mechanism of the invention cooperatively related to the ATM transport conveyor mechanism, showing the retrieval mechanism in normal position permitting a customer to remove dispensed bills from the ATM.
Figure 4:
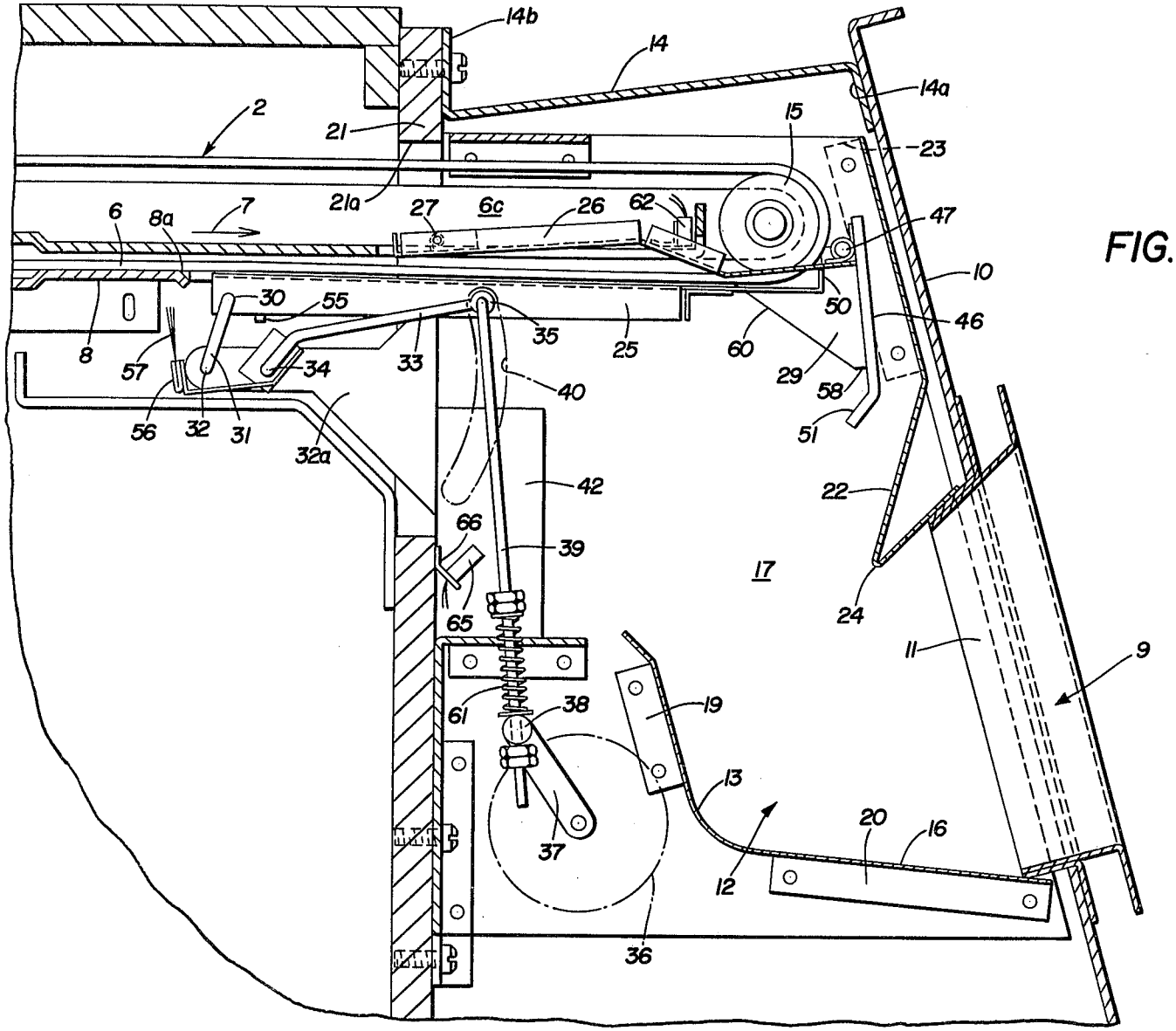
FIG. 4 is a view similar to FIG. 3 illustrating a movable tray component of the retrieval mechanism moved to retrieval position.

A bill receiving and presentation tray 25 is mounted for movement within the delivery compartment 12, between a normal position as shown in FIG. 3 and a retrieval position as shown in FIG. 4. The upper end of the tray 25 extends through an opening 21*a* formed in the ATM interior wall. This enables the tray 25 to underlie an extended portion of the belt conveyor 6 from the delivery end 8*a* of the platen 8 to the delivery end 15 of belt conveyor 6.

A baffle plate 26 is hinged on a pivot shaft 27 and is located in the delivery compartment 12 above the tray 25. The tray 25 and baffle plate 26 extend laterally across the delivery compartment 12 between the side walls 17 and 18.

The baffle plate 26 preferably is biased toward tray 25 by torsion springs 28 located at the ends of pivot shaft 27 and preferably is provided near its lower end with triangular side flanges 29 for coordination of its movement to be described, with movement of the tray 25 when the latter moves between normal position of FIG. 3 and retrieval position of FIG. 4.

The upper end of the tray 25 is pivoted at 30 to a link 31 which is pivoted at its other end to a fixed pivot 32 mounted on a bracket 32*a* carried by the wall 21 inside of opening 21*a* and below belt conveyor 6.

Movement of tray 25 is controlled by an angular link 33 the upper end of which is pivotally mounted on a fixed pivot 34 also mounted on bracket 32*a*. The other end of link 33 is pivotally mounted on a pivot 35 which is connected, in a manner to be described, to a central portion of a downturned flange 25*a* extending along the edge of tray 25 adjacent side wall 18.

A motor 36 is mounted on housing side wall 18 (FIG. 5) below and behind the delivery compartment 12 as indicated in dot-dash lines in FIG. 3, and has a crank arm 37 the outer end of which is pivotally connected at 38 to the lower end of a link 39.

Figure 5:
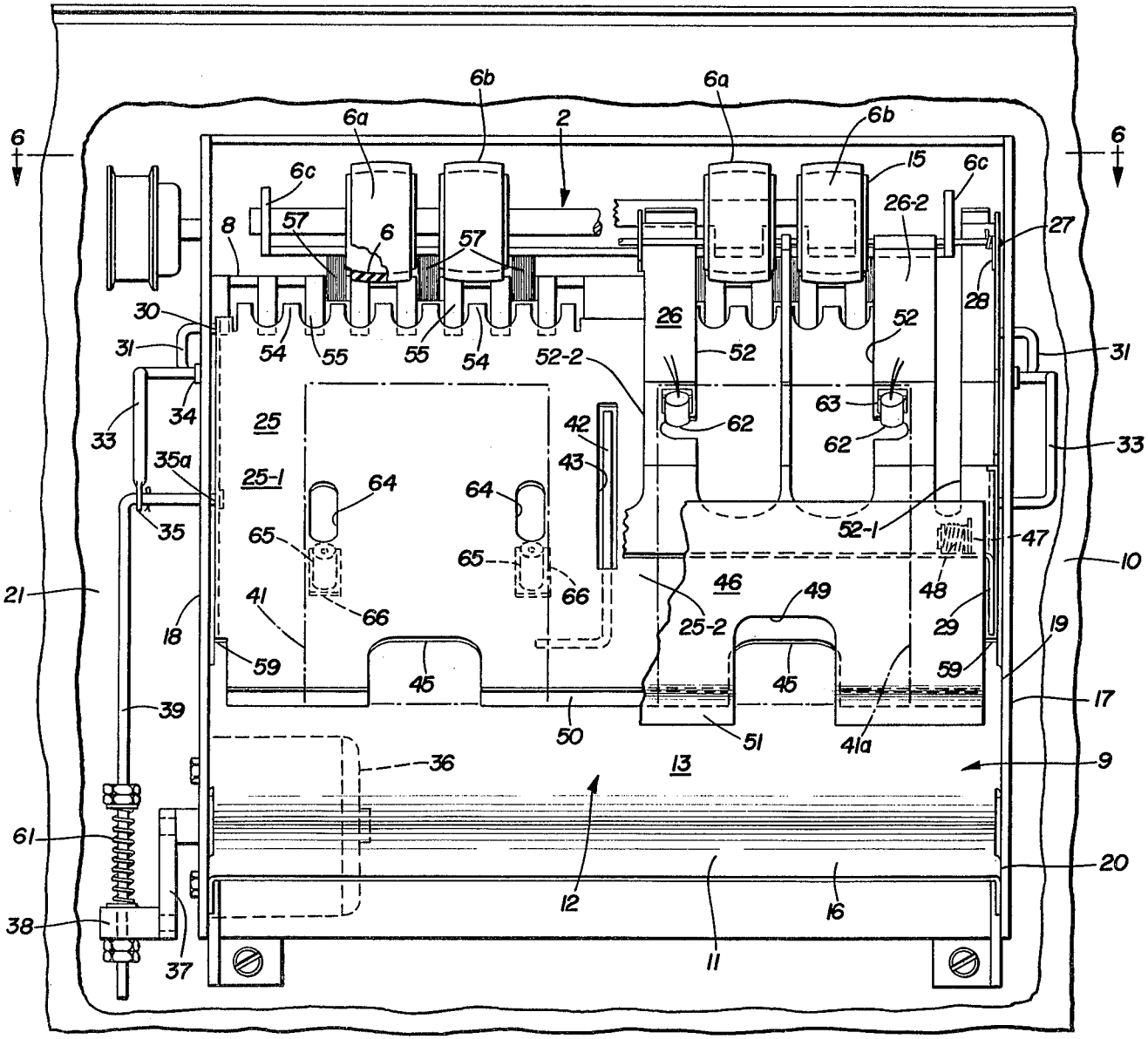
FIG. 5 is a fragmentary front view of the retrieval mechanism looking in the direction of the arrows 5—5, FIG. 3.

The upper end of motor drive link 39 preferably is provided with an angular portion identified above as the pivot 35 which is connected to a central portion 35*a* of the tray flange 25*a* and on which one end of the link 33 is pivoted (FIG. 5).

As shown in FIG. 5, the motor shaft of motor 36 extends through side wall 18 and the crank arm 37, pivot connection 38, link 39 and angular link 33 are all located to the left of housing side wall 18. However, the pivot portion 35 on the upper end of link 39 extends through a slot 40 formed in said side wall 18 to enable a pivot connection 35*a* thereof to be established with the downturned flange 25*a* on the tray 25.

For convenience in illustrating and describing the various connections between the various links and fixed and movable pivots, the side wall 18 is omitted from FIGS. 3 and 4 in order to show the interconnections thereof and the positions of such parts when the tray 25 is in normal position as well as in retrieval position.

The outline, however, of the slot 40 formed in the housing side wall 18 is illustrated in dot-dash lines in FIGS. 3 and 4. In this manner the pivot member 35 is permitted to move in an unobstructed manner within the slot 40 and extend through housing side wall 18 as the tray 25 is moved or driven between its two positions by the described drive motor 36.

Figure 7:
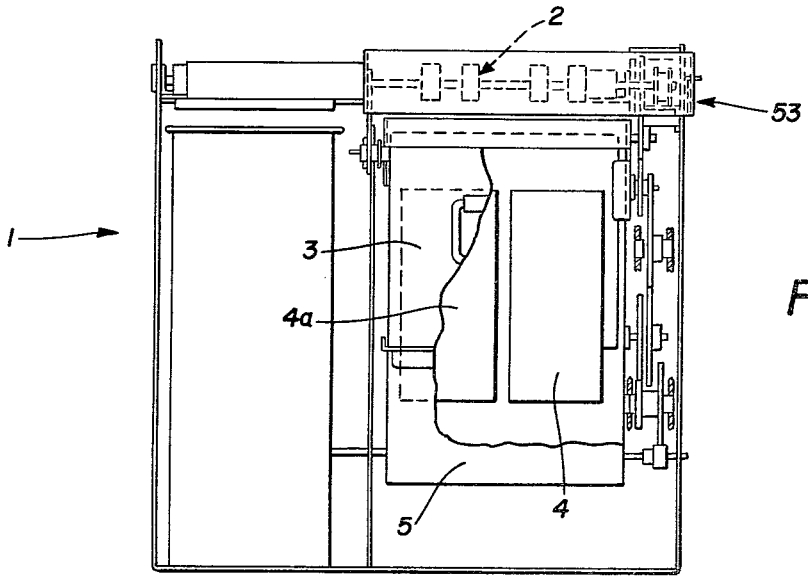
FIG. 7 is a diagrammatic end view of the typical ATM shown in FIG. 2, with parts broken away, looking in the direction of the arrows 7—7, FIG. 2.
Figure 6:
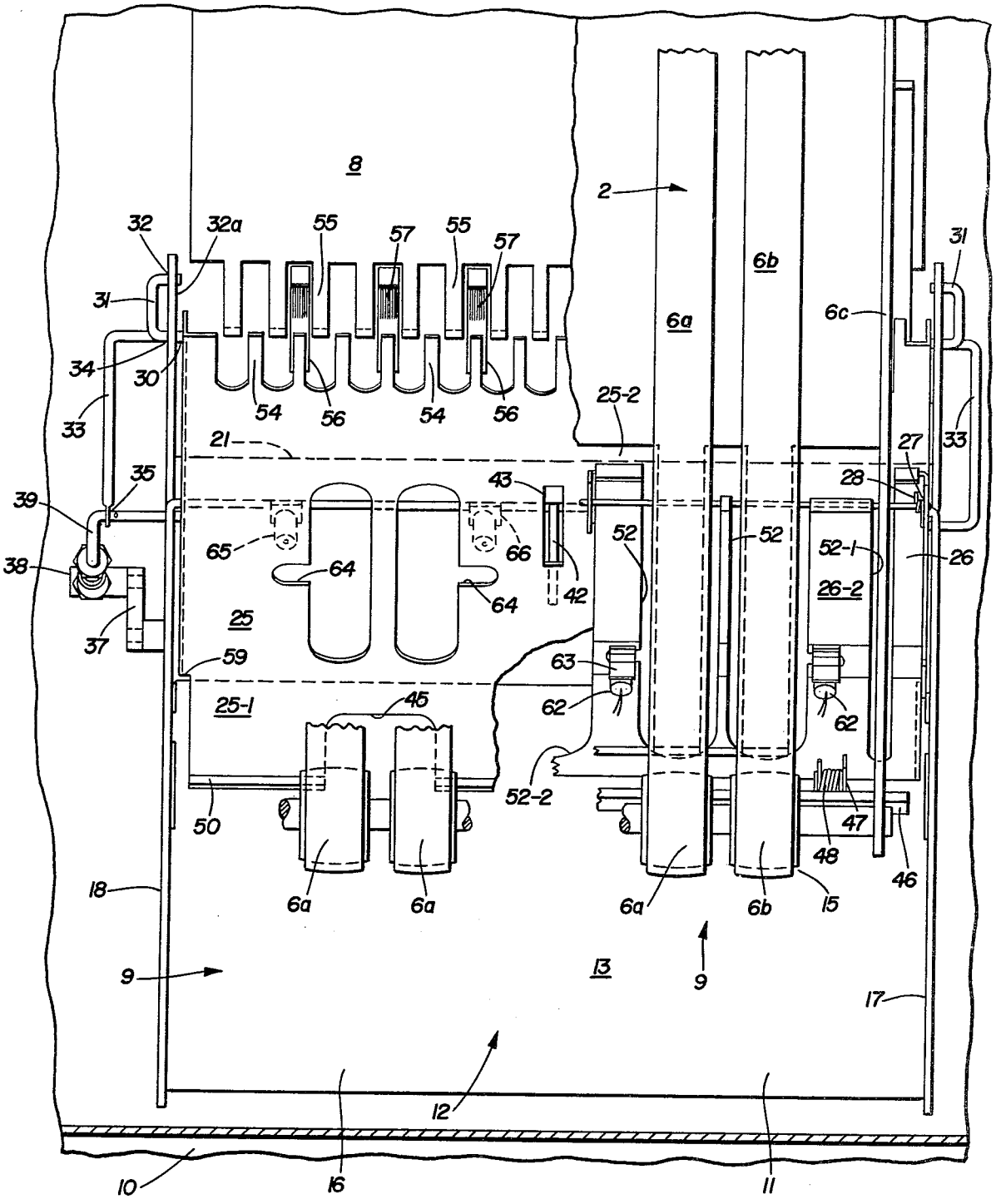
FIG. 6 is a fragmentary top view of the retrieval mechanism parts shown in FIGS. 4 and 5, looking in the direction of the arrows 6—6, FIG. 5.

As indicated above and in FIG. 7, two denominations of bills may be contained in bill supply containers 4 and 4*a*. The bills dispensed from the containers 4 and 4*a* are conveyed by the transport belt conveyor 6 and are discharged side by side onto the tray 16. Bills 41 are dispensed from the container 4 as indicated in FIG. 5 beside bills 41*a* dispensed from container 4*a*. Preferably the bills are maintained separated on the tray by a divider flange 42 which passes through a slot 43 in tray 25. The tray 25 as shown in FIGS. 5 and 6 has sections 25-1 and 25-2. Baffle 26 has similar sections, Section 26-2 being indicated in FIGS. 5 and 6. The bills 41 and 41*a* are received at the delivery compartment 12 between tray 25 and baffle 26.

The lower flanged ends of the tray sections may have notches 45 formed therein through which a customer may engage the underside of bills 41 and 41*a* on the tray when removing the bills from the tray as described below.

A flap member 46 is pivotally mounted at 47 at the lower end of each baffle section and is biased by a torsion spring 48 on the pivot 47 to a closure position as illustrated in FIG. 3. These flaps 46 also may have finger notches 49 formed therein similar to the notches 45 through which a customer may extend a finger to lift a flap 46 and to then grasp bills 41 or 41*a* on the tray sections 25-1 or 25-2.

The bills 41 or 41*a* that are dispensed from the belt conveyor 6 accumulate on the tray 25 on either section thereof and are held on the tray 25 by upturned flanges 50. When the tray 25 is in normal position (FIG. 3) the flanges 50 are covered by the angular end portions 51 at the lower end of the flaps 46.

The usual transport conveyor belt mechanism 6 includes two endless narrow belts 6*a* and 6*b* (FIGS. 5 and 6) for each dispenser section that delivers bills of one denomination. These belts 6*a* and 6*b* are spaced apart. The baffle 26 must be provided with slots 52 of sufficient width to telescope over portions of the spaced belts 6*a* and 6*b* when the baffle 26 is moved to a retrieval position shown in FIG. 4. Another slot 52-1 is formed adjacent the outer edge of each baffle section to clear the conveyor support members 6*c*. The slots 52 have a further function in reducing the amount of static electricity which may sometimes develop in operation of the equipment as paper money bills are discharged by the belt conveyor 6 and strike the underside of the baffle 26. The slots 52 eliminate considerable surface to which the bills may cling from static buildup particularly when the baffle 26 is formed of sheet metal. Baffle 26 also may have a central slot 52-2.

Figure 2:
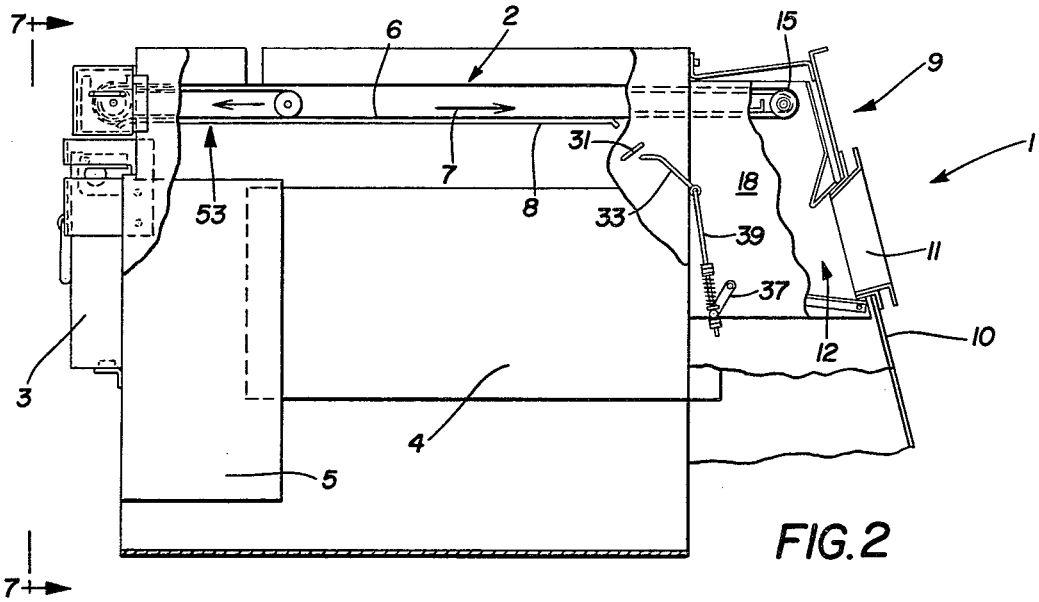
FIG. 2 is a diagrammatic side view illustrating a typical ATM having a reversible transport conveyor mechanism and a sealed tamper-indicating divert container equipped with the improved retrieval mechanism.

The belts 6*a* and 6*b*, four in all, for the two sections of the reversible conveyor 2 for the ATM 1 (FIGS. 5 and 6) may be driven by the typical conveyor drive indicated generally at 53 in FIG. 2. As indicated, this conveyor drive, such as described in said U.S. Pat. No. 4,313,601, is reversible through the control circuitry for the operation of an ATM which is equipped with a divert container 3.

The tray 25 at its upper end preferably is provided with a comblike formation with spaced fingers 54 which are intermeshed with spaced fingers 55 formed on the discharge end 8*a* of the conveyor platen 8. These meshed fingers provide a smooth guideway for the bills being delivered by the conveyor 6 to the delivery compartment 12. In this manner dropping of the bills elsewhere in the ATM without discharge to the delivery compartment 12 is prevented.

An L-shaped bracket 56 is mounted on the tray 25 as shown in FIG. 3 having flexible brush bristles 57 projecting upwardly therefrom at an angle through the spaces between the comblike interlaced fingers 54 and 55. These brush bristles 57 in normal operation of the ATM prevent bills from being returned to the equipment when intended to be dispensed, as a result of some malfunctions of the equipment. However, such brush bristles must be removed from the path of movement of unpicked bills which are to be retrieved. Thus, the bristles are on brackets 56 which are mounted on the tray 25 so that when the tray is moved to retrieval position illustrated in FIG. 4 the brush bristles are moved out of the path of movement of the conveyor belt (FIG. 4).

FIG. 3 indicates the relative positions of the tray 25 and baffle 26 when the retrieval mechanism is in normal position. Baffle 26, although biased toward tray 25 by spring 28, is held in the spaced relationship indicated by the triangular flanges 29 at the lateral edges of baffle 26, the pointed ends 58 of which engage notched shoulders 59 at the lower corners of the tray 25 (FIG. 5).

During movement of the tray 25 from the normal position of FIG. 3 to the retrieval position of FIG. 4 the relative location of the baffle 26 with respect to the tray 25 changes as shown in FIG. 4. Such change of relative location is permitted because the angled edges 60 of the triangular edge flanges 29 on the baffle 26 slide along the notched shoulder 59 on the tray 25. As the retrieval position is approached, the slots 52 in the baffle telescoped over portions of the spaced belts.

Thus, the tray 25 finally arrives at retrieval position parallel with and pressing against the lower reaches of the belts of belt conveyor 6. Meanwhile, at the time when the motor 36 is energized to move the tray 25 to retrieval position, the drive of belt conveyor 6 is reversed to move the lower reaches of the belts in a direction opposite to the direction of arrow 7 so that one or more bills stacked or accumulated on the tray 25 and unpicked, are pressed against the moving conveyor belt and are withdrawn from the tray and pass in the direction opposite to that of arrow 7 along the conveyor and are discharged into the divert container 3 with which the ATM is equipped.

The crank arm 37 of retrieval motor 36 is shown in FIG. 3 and described as being pivotally connected at its outer end 38 of link 39. Preferably this pivotal connection 38 is yieldingly and slidably mounted on the lower end of link 39 biased to the position shown by the spring 61. In this manner a yieldingly drive connection is established so that some undetermined blockage of the retrieval mechanism preventing movement of the tray 25 from normal position will not damage the motor 36 since the spring 61 will yield to motor crank arm movement.

The retrieval mechanism, when operating by energizing retrieval drive motor 36, rapidly and repeatedly moves the tray 25 between normal and retrieval positions so that all unpicked bills which may have accumulated on the tray, will be withdrawn or retrieved and delivered by the reversed conveyor to the divert container 3. When the motor 36 is de-energized at the conclusion of retrieval operation when the sensor no longer detects unpicked bills on the tray 25, it normally comes to rest with the tray 25 in the normal position as shown in FIG. 3.

The retrieval mechanism and control circuitry thereof in the control circuitry for the ATM includes a sensor for sensing the presence of unpicked bills in the delivery compartment 12. This sensor preferably may provide sources of light 62 mounted at 63 on the baffle 26 which are projected through openings 64 formed in the tray 25 to light-sensitive receivers 65 mounted at 66 on one of the housing walls. When a light beam is interrupted from passing from source 62 to the receiver 65 by the presence of one or more unpicked bills on the tray 25, the receiver 65 is actuated to energize, after a short time delay, the motor 36 so that the tray 25 is raised and the unpicked bills sensed are withdrawn from the tray and delivered to the divert container 3.

During operation of the retrieval mechanism to retrieve unpicked bills from the tray 25 as described, the operation of the retrieval drive motor 36 and the reversal of movement of the conveyor 6 are coordinated. When unpicked bills are detected, sensed by the sensors 62–65, the retrieval drive motor 36 is energized at the same time that conveyor movement is reversed.

During retrieval operation the downturned fingers 55 on the platen 8 have spaces between said fingers 55 and the fingers 54 on the tray 25 through which the bristles 57 project.

In this manner unpicked bills remaining in the delivery compartment 12 of the ATM at the end of a bill dispensing operation, which otherwise normally has been carried out in a usual manner, are sensed and after a short time delay, the dispensing operation automatically retrieves the unpicked bills and delivers them to the divert container with which the ATM is equipped.

Accordingly, the new unpicked dispensed bill retrieval mechanism of the invention satisfies the stated objectives and solves problems and answers needs that have existed in the art.

In the foregoing description, certain terms have been used for brevity, clearness and understanding but no unnecessary limitations are to be implied therefrom beyond the requirements of the prior art because such terms are used for descriptive purposes and are intended to be broadly construed.

The retrieval mechanism primarily is intended to retrieve bills that have been issued as a result of a cash dispensing operation and are located in the tray. In one instance of such a cash dispensing operation, the correct number of bills is delivered to the tray but such bills have not been removed by the customer. In another instance, malfunction of the dispenser may have delivered an incorrect number of bills to the tray which the control system of the mechanism senses. An example of a malfunction is a power failure which would deliver an incorrect number of bills.

When such malfunction is sensed, the retrieval mechanism is actuated to retrieve the bills characterized by an incorrect count in the same manner as those which have not been removed though correct in number.

Accordingly, when the term "unpicked bills" is used herein, the term is intended to include not only unremoved bills but also an accumulation of bills with an incorrect count.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set forth in the appended claims.

We claim:

1. In an ATM dispenser having a reversible belt conveyor a retrival mechanism for unpicked paper money bills dispensed by the ATM dispenser mechanism and discharged from the delivery end of said dispenser mechanism's reversible belt conveyor to a bill delivery station including, a bill receiving and presentation tray mounted for movement at said delivery station between a normal position receiving bills discharged by said conveyor for customer removal, and a retrieval position for withdrawal from the tray of unpicked bills thereon by said conveyor belt delivery end when the conveyor is reversed; drive means for moving the tray between normal and retrieval positions; sensor means operative, when sensing unpicked bills on the tray when in normal position, to energize the drive means to move the tray to retrieval position; and means for reversing belt conveyor movement upon energizing said drive means.

2. The construction defined in claim 1 in which a bill delivery compartment is formed in the ATM at said bill delivery station communicating with the delivery end of said conveyor; in which the tray has at least one opening therein; and in which said sensor means provided for energizing the drive means of said retrieval mechanism includes, a light source mounted in the compartment projecting a light beam through said tray opening, and a light receiver located beneath said opening receiving said beam when said opening is unobstructed, and activated by the presence of at least one unpicked bill on said tray to energize the drive means.

3. The construction defined in claim 1 in which a bill delivery compartment is formed in the ATM at said bill delivery station communicating with the delivery end of said conveyor; in which the tray is located in said compartment below and underlying an extended portion of said conveyor delivery end and is spaced from said delivery end when in normal position; and in which the tray presses unpicked bills thereon against said conveyor extended delivery end portion when the tray is in retrieval position; whereby said conveyor end portion when reversely moving withdraws unpicked bills from said tray.

4. The construction defined in claim 3 in which the tray is rapidly moved between normal and retrieval positions when unpicked bills are sensed on the tray, whereby all unpicked bills on the tray are withdrawn by the conveyor from the tray.

5. The construction defined in claim 1 in which said drive means has yielding drive connection with the tray.

6. The construction defined in claim 5 in which said drive means includes a drive motor having a crank arm pivotally connected to a lever pivotally connected to the tray; and in which there is a yielding pivotal connection between the crank arm and lever.

7. The construction defined in claim 1 in which a bill delivery compartment is formed in the ATM at said bill delivery station communicating with the delivery end of said conveyor; in which a baffle plate is pivotally mounted in said compartment spaced above the tray and biased for movement toward the tray to deflect bills discharged from the conveyor onto and to retain such bills on the tray.

8. The construction defined in claim 7 in which the baffle plate has openings formed therein to reduce the effect of static electricity on said baffle plate as bills are discharged against the baffle plate for collection on the tray.

9. The construction defined in claim 7 in which the tray is mounted for movement in said compartment on pivot means journaled in the ATM; and in which the tray moves toward the baffle plate and each of the tray and baffle plate move pivotally as the tray is moved to retrieval position.

10. The construction defined in claim 9 in which interengageable means are formed on the tray and baffle plate to control movement of the tray toward the baffle plate including flanges at the side edges of the baffle plate having angular edges slidably engaged with notched shoulders at the outer end corners of the tray.

11. The construction defined in claim 1 in which a bill delivery compartment is formed in the ATM at said bill delivery station communicating with the delivery end of said conveyor; and in which the tray has an upturned bill-holding flange at its outer end adjacent an access opening provided for said compartment at said bill delivery station.

12. The construction defined in claim 11 in which a baffle plate is pivotally mounted in said compartment spaced above the tray and biased for movement toward the tray; and in which a flap is pivotally mounted at the outer end of said baffle plate biased toward the tray flange to a tray closure position.

13. The construction defined in claim 12 in which the outer flanged end of the tray and an adjacent portion of said flap are notched to facilitate a customer grasping bills on said tray for removal.

14. The construction defined in claim 1 in which a bill delivery compartment is formed in the ATM at said bill delivery station communicating with the delivery end of said conveyor; in which said conveyor has a platen having a discharge end formed with spaced downturned fingers; in which pivotal means is provided adjacent said platen discharge end for movement of the tray in said compartment between normal and retrieval positions; and in which the pivotally mounted end of said tray has comblike formation with spaced fingers intermeshed with the spaced fingers formed on the discharge end of said conveyor platen; whereby a smooth guideway for bills being delivered by the conveyor to said tray is provided.

15. The construction defined in claim 14 in which brush bristles are mounted on bracket means carried by the pivoted end of said tray which project upward, across the normal path of travel of bills delivered by said conveyor, through spaced between the intermeshed fingers of said platen and tray when the tray is in normal position; and in which said brush bristles are withdrawn from projecting across said path of travel when the tray is moved to retrieval position.

16. In a cash dispensing ATM having a reversible conveyor which during normal conveyor dispensing movement in one direction of travel transports paper money bills received from a bill supply to a delivery end of the conveyor at a bill delivery station for removal through a station access opening by a customer; and in which, when paper money bills are to be diverted during ATM operation from travel in said one direction, said conveyor is reversed to transport in the other direction of conveyor travel, said bills received by the conveyor which are to be diverted, to a divert container with which the ATM is equipped at a divert station; wherein the improvement comprises:

(a) tray means located below said conveyor delivery end for receiving dispensed bills discharged from said conveyor mounted for movement between normal and retrieval positions in a bill delivery compartment formed at said bill delivery station;

(b) drive means for moving the tray means between normal and retrieval positions;

(c) sensor means operative when sensing unpicked bills on said tray means to energize said drive means to move the trays means to retrieval position and coincidentally to reverse conveyor movement; and (d) said tray means when in retrieval position pressing bills on said tray means against the reversely moving conveyor delivery end enabling conveyor bill withdrawal from the tray means and transport of such bills so retrieved to said divert container.

17. The construction defined in claim 16 in which the tray means is rapidly moved between normal and retrieval positions when unpicked bills are sensed on the tray.

18. The construction defined in claim 16 in which the sensor means includes light beam means which are interrupted by unpicked bills on the tray means to energize said drive means.

19. The construction defined in claim 18 in which a baffle plate is pivotally mounted in said compartment spaced above the tray means to form a closure for the tray means; in which the sensor means include a light source and a light receiver; and in which the light source is mounted on the baffle plate.

20. The construction defined in claim 19 in which the light source projects a light beam toward the light receiver through an opening formed in said tray means which is interrupted by unpicked bills on the tray means to energize the retrieval mechanism.

21. The construction defined in claim 20 in which interengageable means are formed on the baffle plate and tray means to control the space between the baffle plate and tray means as the tray means is moved from normal to retrieval position; and in which said space is reduced as the tray means moves to retrieval position.

22. The construction defined in claim 21 in which the tray means has an upturned flange at its center end to hold bills on the tray means until removed by a customer or when unpicked until retrieved.

23. The construction defined in claim 22 in which said tray means and baffle plate have aligned notches formed in their outer ends to facilitate bill removal from the tray means by a customer at said delivery station.

24. In an ATM provided with a dispenser for paper money bills having a reversible belt conveyor which in one direction of conveyor movement transports bills to be dispensed from a bill supply to a delivery end of the conveyor at a bill delivery station for removal through a station access opening by a customer; and in which said conveyor when reversed, during conveyor movement in the other direction, transports bills received by the conveyor intended to be diverted during ATM operation, to a divert container with which the ATM is equipped at a divert station; wherein the improvement comprises unpicked bill retrieval mechanism at said bill delivery station including:

(a) walls forming a delivery compartment enclosing the delivery end of said conveyor;

(b) a bill receiving and presentation tray in said compartment onto which dispensed bills are discharged by said conveyor;

(c) means mounting said tray for movement in said compartment between a normal position permitting customer removal of bills on the tray through said access opening, and a retrieval position;

(d) drive means for moving the tray between said normal and retrieval positions;

(e) sensor means for sensing the presence of unpicked bills on the tray;

(f) the sensor means when sensing the presence of unpicked bills on the tray reversing conveyor movement and enabling said drive means to move the tray to retrieval position; and (g) said tray when moved to retrieval position pressing the unpicked bills on the tray against the reversely moving conveyor which withdraws said unpicked bills from the tray and transports such bills to said divert container.

* * * * *